United States Patent [19]

Liedgens

[11] 3,985,329

[45] Oct. 12, 1976

[54] COLLAPSIBLE MOLDS AND SPACERS THEREFOR

[76] Inventor: Karl Liedgens, Herchener Strasse 26, 5231 Weyerbusch, Germany

[22] Filed: Mar. 24, 1975

[21] Appl. No.: 561,065

[30] Foreign Application Priority Data

Mar. 28, 1974 Germany ..... 2414951

[52] U.S. Cl. ..... 249/40; 249/216

[51] Int. Cl.[2] ..... E04G 17/08

[58] Field of Search ..... 249/40–46, 249/190–191, 213–218; 52/699

[56] References Cited

UNITED STATES PATENTS

| | | | |
|---|---|---|---|
| 1,069,821 | 8/1913 | Sherwood | 249/213 |
| 1,973,941 | 9/1934 | Anderson | 249/218 |
| 2,750,648 | 6/1956 | Hallock | 249/41 |
| 3,734,453 | 5/1973 | Bailey | 249/40 |

FOREIGN PATENTS OR APPLICATIONS

| | | | |
|---|---|---|---|
| 1,188,549 | 4/1970 | United Kingdom | 249/40 |

*Primary Examiner*—Robert D. Baldwin
*Assistant Examiner*—John McQuade
*Attorney, Agent, or Firm*—Steinberg & Blake

[57] ABSTRACT

Spacer for the connection of mold plates for making collapsible molds elements comprising a spacing portion which has at its ends holding portions, hinge like secured thereto via flexible hinges, wherein said spacing portion and said holding portions at its ends connected with one another via the flexible hinges are one piece of plastic material; and molds made therefrom.

14 Claims, 10 Drawing Figures

COLLAPSIBLE MOLDS AND SPACERS THEREFOR

Figure 1:
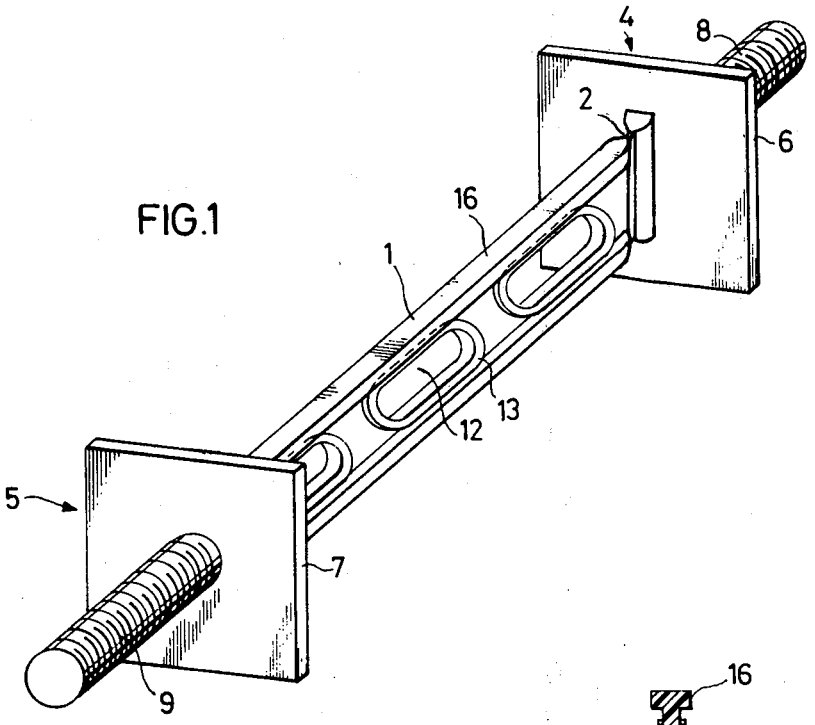

The invention relates to molds, such as concrete molds, and spacers for the connection of mold plates for making collapsible site molds.

In order to further rationalize particularly constructional building, it has been known to make use of premanufactured molds. In order to be able to transport these elements in a space saving way, it has been tried to connect lightweight plates using spacers whereby the spacers have been connected via hinges to the plates to make possible a folding up of the elements for transport.

In these prior art embodiments, the spacers comprise a plurality of components for instance dowels inserted from the outside into the mold plates while the dowels are provided, on the inner side thereof, with openings perpendicular to the dowel axis into which a U-shaped bracket can be inserted so that the two mold plates are spaced apart. In a further embodiment, the mold plates are connected via spacers provided, at their ends, with hinges. These spacers constitute relatively expensive steel elements which even in the case of folded-up molds require relatively large space for transport.

It is now an aim of the present invention to provide a spacer for the connection of mold plates for making collapsible molds which are not expensive in the manufacture, can be mounted easily, offers a great stability to the mold so that it will withstand, without any additional supports, anchorage and so forth, the pressure of the concrete filled in and where the spacer at the same time makes possible to fold the mold up flat for transport so that little transport space is required.

The problem of the invention is solved with the aid of a spacer of the kind described above comprising a spacing portion which includes holding portions hinge-like provided at the ends thereof and connectable to the mold plates which is characterized in that the spacer and the holding portions hinge-like provided at the ends thereof are manufactured as one piece from plastic material and are connected via plastic hinges with one another.

Such a spacer can cheaply be manufactured by die casting from common plastic materials and makes possible, with the aid of the plastic hinges provided in the die casting process, a flat folding up of the mold for transportation.

In this connection, it has proved to be of advantage if the holding portions hinged via the plastic hinges consist each of a plate for resting against the mold plate and a portion extending through an opening of the plate and having fastening means at its end.

As the fastening means, all means can be employed that are commonly used for such purposes. The portion extending through the mold plate can for instance be provided, at its circumference, with grooves into which, or around which, particularly formed cramps or springs will engage.

It has shown to be particularly advantageous if the portion extending through the opening of the formwork plate is provided with a thread on which, from the outside, a clamping nut can be screwed on. The clamping nut can suitably be shaped as a pipe nut having at the end a counter plate so that it covers the threading of the portion extending through the mold plate and provides, at the same time, for a smooth termination. This is particularly advantageous as the mold plates are used, as a rule, as a lost shuttering which remains in the building and on the other hand there is the possibility to wholly or partly demount, in a simple way, the premanufactured mold element so that steel reinforcements or other elements can be inserted into the concrete.

For certain applications it has proved to be of advantage if the portion which extends through the opening of the mold is provided with an internal thread into which, from the outside, a holding screw can be inserted.

In such an embodiment damaging of the thread by the edges of the mold plate is safely avoided.

As the spacers will remain in the completed building, it has shown to be particularly useful if the portion extending through the mold plate is provided with an axially directed opening.

This opening can be closed when the building is finished by a corresponding covering cap; on the other hand, this portion which is firmly anchored in the building can be used as a dowel to receive the wood screws for fastening facing plates, wall linings, and the like or for securing the scaffolds. In accordance with a further advantageous embodiment of the present invention, the axially directed opening is provided with an inner thread. Such an inner thread will ensure even considerably better tensile strengths for the purposes mentioned.

In accordance with a further advantageous embodiment of the present invention, the portion extending through the opening of the mold plate is provided with one, or a plurality of, perpendicular bores into which bolts, pegs or other holding means can be inserted.

As to the shape of the spacing portion, any shape can, on principle, be employed. It has however shown to be advantageous if the spacing portion which fixes the distance between the mold plates is made from flat bar material. In this way, it will not use additional space when the mold elements are collapsed, but will, on the other hand, completely correspond to the requirements as to the stability of the mold.

It has shown to be of particular advantage if the spacing portion is made from flat flexible bar material.

The stability of the spacing portion is further increased if it is provided at its longitudinal edges with a reinforcement rib so that the spacing portion I-shaped cross section.

The stability of the spacer of the invention in the ready masonry is further increased in that the spacing portion is provided, in the connecting bar, with one, or a plurality of, passages. These passages are filled when casting the concrete into the molds and safeguard an additional stability which is of a particularly great advantage if the portions extending through the mold plates are at the same time used for securing scaffolds, facing plates, and the like.

In accordance with a further advantageous embodiment, the stability of the spacers in the masonry is further increased in that the passages provided in the spacing portion are furnished with a reinforcement edge.

With a view to the manufacture, this embodiment can be made very easily without any additional difficulty; on the other hand, it adds considerably to the stability of the spacer in the masonry.

For the production of the spacers of the invention, any plastic materials can be used which have a sufficient stability. As a rule, polyethylene or, which is particularly preferable, polypropylene, are sufficient.

In accordance with the present invention, the spacers can be combined together with two mold plates to form a mold which is characterized in that the mold plates are connected with one another by three or more spacers. Although folding up of the mold is always possible, particularly when using flexible spacing portions, it has shown to be especially advantageous if the axes of the flexible hinges provided between the spacing portion and the hinged holding portions are parallel relative to each other.

Figure 4:
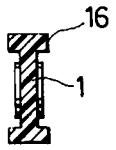
Figure 2:
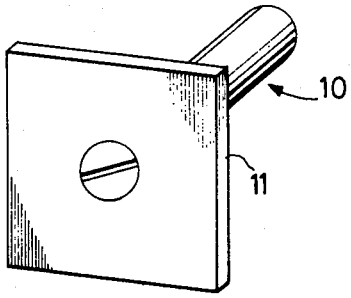
Figure 3:
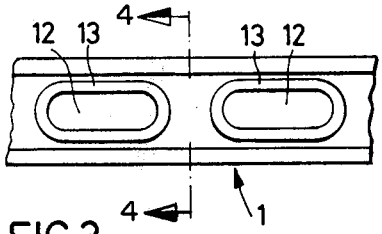
Figure 5:
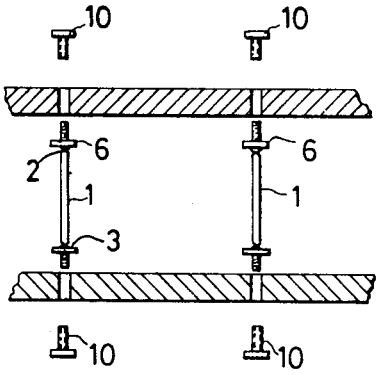
Figure 6:
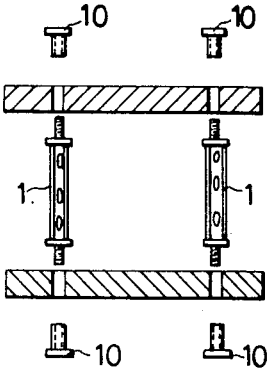
Figure 7:
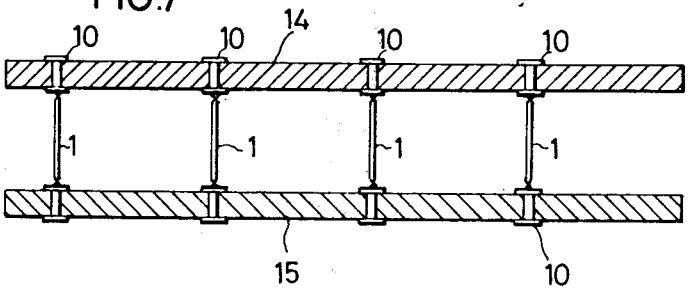
Figure 8:
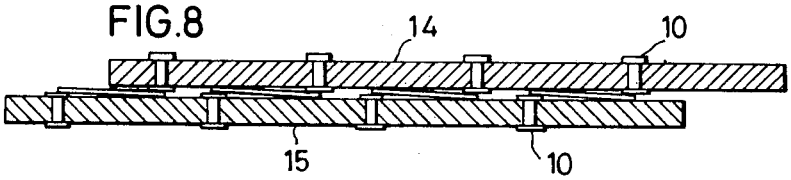
Figure 9:
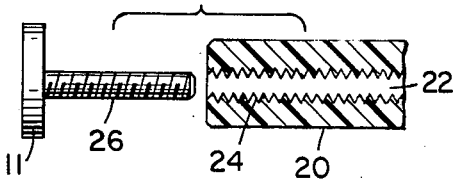
Figure 10:
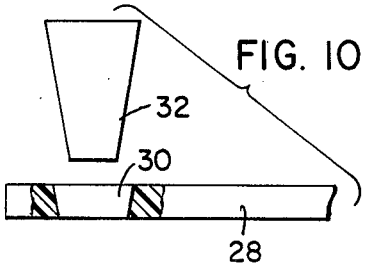

The invention will now be described in more detail in connection with the embodiments shown in the attached drawings wherein FIG. 1 shows a perspective view of a spacer of the invention for connecting mold plates, FIG. 2 shows a fastener shaped as a pipe nut for securing the mold plate to the spacer of the invention, FIG. 3 is a fragmentary side view of the spacing portion of the spacer, FIG. 4 is a section along line 4—4 of FIG. 3, FIG. 5 is a partly sectional top view of components at the site, FIG. 6 is also a top view of components at the site with the spacers shown turned through 90° from the position shown in FIG. 5, FIG. 7 shows partly in section a mold structure ready for use, FIG. 8 shows the mold of FIG. 7 in a collapsed condition, FIG. 9 is a partly sectional fragmentary illustration of a different type of fastener means at each end of the spacer, and FIG. 10 is a fragmentary partly sectional illustration of yet another type of fastener means adapted to be located at each end of the spacer.

The spacer according to the invention shown in FIG. 1 comprises a spacing portion 1 on both ends of which holding portions 4 and 5 each are hinged via flexible hinges 2 and 3. Each holding portion 4, 5 includes a plate 6, 7 for resting against a mold plate and a fastener portion 8, 9 for extending through an opening of the mold plate. To secure the holding portions, the portions 8, 9 extending through the mold plates are provided with an outer thread, and holding nut 10 shown in FIG. 2, which is shaped as a pipe nut, is screwed on it to secure the mold plate, with covering plate 11 at its end.

The spacing portion 1 is provided with passages 12 each having a reinforced edge 13.

In FIG. 3, this spacing portion 1 and its passages 12 with the reinforced edges 13 is again shown in a fragmentary view. A section through this spacing portion along line 4—4 is shown in FIG. 4. It will be seen that at its opposed edges the spacing portion 1 is provided with reinforcements 16 so as to give the spacing portion the I-shaped configuration shown in FIG. 4.

In FIGS. 5 and 6, the components of the mold at the site are shown from above. Thus, it will be seen that in the exploded views of FIGS. 5 and 6 the mold plates are illustrated in section while the spacers 1 are shown in FIG. 6 turned through 90° with respect to the positions thereof shown in FIG. 5. For reference, the same numerals have been used that have been used in connection with FIGS. 1 through 4. In FIG. 7, the ready-mounted mold comprising two plates 14, 15 is shown in a condition ready for use. By shifting the plates relative to each other, it can be folded up for transport, as shown in FIG. 8.

As the axes of the flexible hinges of the spacers are arranged in parallel relative to each other, as shown in FIGS. 5 through 8, a folding-up or collapsing of the mold of the invention is possible into one direction only.

In the unfolded state, an extreme stability of the mold is obtained.

The term "flexible hinge" as used in the present application is meant to describe a hinge-like connection between two plastic portions which is shaped, together with them, from one piece and consists of a portion constricted or thinned along a certain line (hinge axis) which is therefore flexible.

Flexibility of this portion makes the hinge-like folding or swivelling possible.

FIG. 9 illustrates how the elongated fastener portions 20, corresponding to the portions 8 and 9 at each end of the spacer of the invention, can be formed with an axial bore 22 and provided with an interior thread 24 so that an elongated screw 26 can be threaded into the internal bore 22 of each fastener portion 20. This screw 26 will of course have at its end a holding plate 11 which is the same as the plate 11 shown in FIG. 2 and which is adapted to engage the exterior surface of the mold plate.

In the case of FIG. 10, the elongated fastener portion 28, corresponding to the portions 8 and 9 at each end of the spacer 1 is formed with a tapered bore 30 passing transversely through this fastener portion 28, and in this case a tapered pin 32 is adapted to be driven into the bore 30. In this case the pin 32 will, at its right edge, as viewed in FIG. 10, engage the exterior surface of the mold plate 14 or 15 for holding the latter against the holding portion 4 or 5, or more specifically against the plates 6 and 7 which form the holding portions 4 or 5.

I claim:

1. For use in a mold for concrete or the like, elongated spacer means for interconnecting mold plates and comprising an elongated spacer portion having opposed ends, a pair of holding plates situated at said opposed ends of said elongated spacer portion, and adapted to rest against inner surfaces of a pair of mold plates whose inner surfaces are directed toward each other, and a pair of flexible hinge means respectively interconnecting said holding plates with said spacer portion at said ends thereof for rendering said holding plates turnable with respect to said spacer portion about a pair of parallel axes, respectively, and a pair of fastening means respectively fixed to said holding plates and extending outwardly therefrom away from the spacer portion between said holding plates, said pair of fastening means being adapted to extend through openings of a pair of mold plates for fastening the latter to said holding plates, said spacer portion, holding plates, and flexible hinge means all being integral with each other and made of plastic material so as to form a single body of plastic material.

2. The combination of claim 1 and wherein each fastening means includes an elongated member having an external thread and a nut threaded on to said elongated member.

3. The combination of claim 2 and wherein said nut is in the form of a tubular member having an internal thread and carrying at its outer end a cover plate for engaging an exterior surface of a mold plate.

4. The combination of claim 1 and wherein each fastening means includes an elongated member formed with an internal bore and having an internal thread, and a holding screw threaded into said bore.

5. The combination of claim 1 and wherein each fastening means includes an elongated member adapted to extend through an opening of a mold plate and formed with an internal bore extending axially along said elongated member.

6. The combination of claim 5 and wherein said elongated member is formed with an interior thread at said bore thereof.

7. The combination of claim 1 and wherein each fastening means includes an elongated member adapted to extend through an opening of a mold plate and formed with a bore passing transversely through said elongated member, and a fastener pin received in said bore.

8. The combination of claim 1 and wherein said elongated spacer portion is in the form of a substantially flat bar.

9. The combination of claim 8 and wherein said bar is flexible.

10. The combination of claim 8 and wherein said bar has opposed longitudinally extending reinforced edges and is of a substantially I-shaped cross section.

11. The combination of claim 8 and wherein said bar is formed with at least one passage extending therethrough.

12. The combination of claim 11 and wherein said passage is defined by an endless edge which is reinforced.

13. The combination of claim 1 and including a pair of mold plates respectively having inner surfaces directed toward each other and engaging said holding plates, said mold plates respectively being formed with bores through which the pair of fastening means respectively extend for fastening said mold plates to said spacer means in a manner rendering the assembly movable between a collapsed position where the mold plates are relatively close to each other with the spacer portion extending longitudinally along and situated between the mold plates while being substantially parellel thereto, and an expanded position of use where the mold plates are relatively distant from each other while the spacer portion extends perpendicularly with respect to the mold plates.

14. The combination of claim 13 and wherein the pair of flexible hinge means provide parallel hinge axes situated closely adjacent to the inner surfaces of the mold plates.

* * * * *